United States Patent [19]

Isoard

[11] 4,007,883

[45] Feb. 15, 1977

[54] SIMULTANEOUS BOBBIN WINDING STATION

[75] Inventor: Bernard Isoard, Ecully, France

[73] Assignee: Rhone-Poulenc-Textile, Paris, France

[22] Filed: Dec. 8, 1975

[21] Appl. No.: 638,445

[30] Foreign Application Priority Data

Dec. 9, 1974 France ..... 74.40872

[52] U.S. Cl. ..... 242/35.5 R; 242/18 A

[51] Int. Cl.[2] ..... B65H 54/20

[58] Field of Search ..... 242/35.5 R, 18 A, 18 DD, 242/18 R

[56] References Cited

UNITED STATES PATENTS

| | | | |
|---|---|---|---|
| 2,946,526 | 7/1960 | Kuroiwa et al. | 242/18 A |
| 3,394,895 | 7/1968 | Hogg | 242/18 A |
| 3,550,871 | 12/1970 | Keith | 242/18 A |
| 3,565,355 | 2/1971 | Schippers et al. | 242/35.5 R X |
| 3,604,659 | 9/1971 | Jaeggli | 242/35.5 R |
| 3,628,741 | 12/1971 | Enneking et al. | 242/18 A X |
| 3,697,007 | 10/1972 | Taylor et al. | 242/18 A X |
| 3,801,242 | 4/1974 | Bauch | 242/35.5 R X |
| 3,862,722 | 1/1975 | Pierce | 242/35.5 R |
| 3,876,161 | 4/1975 | Miller | 242/18 A |

FOREIGN PATENTS OR APPLICATIONS

| | | | |
|---|---|---|---|
| 651,216 | 10/1928 | France | 242/18 A |
| 701,386 | 1/1941 | Germany | 242/18 A |

*Primary Examiner*—Stanley N. Gilreath
*Attorney, Agent, or Firm*—Sherman & Shalloway

[57] ABSTRACT

A winding station for winding multiple bobbins in vertically-staggered winding units having two bobbin mounts associated with an upper winding unit and three bobbin mounts at the lower winding unit. Four yarn guides are positioned above both winding units to stabilize the yarn en route to a pair of yarn distributors which are individually associated with the winding units, and a deflecting guide is positioned adjacent the upper of the two yarn distributors to selectively guide one of the yarns which is alternated between the upper and lower winding units.

6 Claims, 1 Drawing Figure

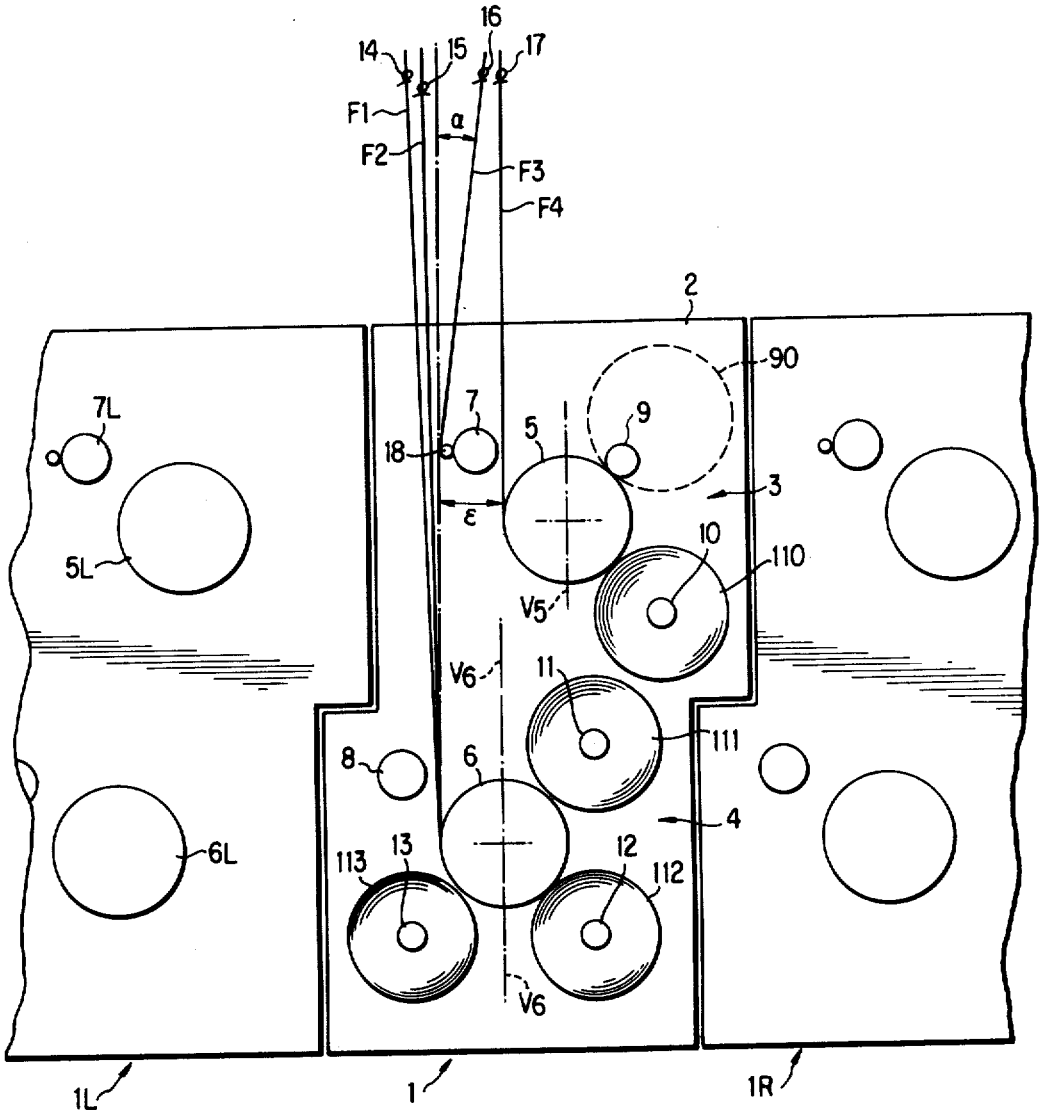
16
14
15
17
F1
α
F2
F3
F4
2
90
7L
7
9
5
18
3
ε
10
110
5L
V5
V6
11
111
8
6
4
6L
113
13
12
112
V6
1L
1
1R

SIMULTANEOUS BOBBIN WINDING STATION

BACKGROUND OF THE INVENTION

The present invention relates to the winding of yarns and is concerned, more particularly, with the simultaneous winding of several spools from a continuous supply and the efficient replacement of filled bobbins or spools with empty bobbins for immediate winding of the continuously delivered yarn.

DISCUSSION OF THE PRIOR ART

Contemporary winding of textile yarns is highly developed and is often conducted at speeds of 3000 to 5000 meters or more per minute.

Typically, these installations include several winding units which can mount and drive one or more of the bobbins or spools on which the yarn is to be wound. The yarn is distributed along the length of the bobbins by a reciprocating distributor which reciprocates along the length of the winding to be made on the bobbins.

The bobbins are on mounts which initially present them in frictional contact with the periphery of a pilot roller and allow them to yield away from the pilot roller, as the winding increases in diameter, to keep the circumference of the winding in contact with the pilot roller. The pilot roller may serve as a drive and speed-governor or as a governor alone, if the bobbin mounts include individual drives.

Most advantageously, these winding units are grouped in vertically staggered pairs to form winding stations which are, in turn, grouped for maximum utilization of space.

However, the more efficiently these units and stations are grouped for space savings, the greater becomes the problem of accessibility for the replacement of wound bobbins with empty bobbins for receiving further windings.

This problem is most acute in installations in which the yarn is continuously formed at high speeds so that a few seconds delay can result in costly waste of several meters of yarn.

For example, in an available winding stations referred to as a 2/2 unit and supplied as Model 585/4 by the Zinser Company, a compact arrangement of vertically staggered, upper and lower winding units, with two bobbin mounts associated with the pilot roller of each of the winding units, permits the simultaneous winding of four bobbins to a diameter of 280mm with a horizontal offset of 600mm between the axes of the corresponding pilot rollers of two adjacent stations. Stated another way, the four 280mm bobbins can be wound, in terms of factory floor spacing, in a space that requires only 600mm between the corresponding upper or lower pilot rollers of adjacent winding stations in the overall installation.

However, when all the bobbins have been fully wound, it is necessary to remove and replace the bobbins during which the continuous, high-speed supply of yarn must be diverted to waste.

The provision of an extra bobbin and mount in each winding unit means that an empty bobbin is immediately ready to receive yarn as the bobbin changing starts. Therefore, a 3/3 winder station can have two vertically-staggered winding units each having three bobbin mounts associated with its pilot roller and distributor, the distributor and the three bobbin mounts being nested about the pilot roller in different quadrants.

With this 3/3 arrangement, empty bobbins are available to receive yarn as soon as a wound bobbin is to be taken off and replaced, thereby saving considerable wastage of yarn during bobbin changes. However, this potential savings in yarn wastage is at the sacrifice of considerable floor space in the overall installation, in order to provide the necessary accessibility for the bobbin change. The spacing between corresponding pilot rollers in adjacent wind stations requires 800mm in a 3/3 machine, as compared to 600mm in a 2/2 machine. This one-third increase is occasioned by the room required by the additional 2 bobbin mounts, and the clearance for their wound bobbins, in the 3/3 machine.

However, the prime purpose of the installation is that of the simultaneous winding of multiple bobbins. Since the 2/2 stations accomplish this with a relative spacing of 600mm between corresponding components of adjacent stations, the additional 200mm required by the 3/3 machines makes them unsuitable or requires careful evaluation against the potential savings in yarn wastage.

Therefore, prior yarn winding stations have not been found entirely satisfactory.

SUMMARY OF THE INVENTION

In general, the preferred form of the present invention comprises a winding station including means for supplying plural yarns to two vertically staggered winding units each having a pilot roll, a distributor and a plurality of bobbin mounts associated with the pilot roller. The upper winding unit includes two bobbins mounts and the lower winding unit has three bobbin mounts, and the yarn supply means include means for alternating one of said yarns between the upper and lower winding units in successive bobbin changes.

OBJECTS OF THE INVENTION

It is an object of the invention to provide a winding station for the simultaneous winding of multiple bobbins which is compact and provides accessibility for changing bobbins.

It is a furher object of the present invention to provide a compact and accessible winding station for simultaneously winding plural bobbins in which the bobbins can be changed without significant waste of yarn.

It is a further object of the present invention to provide a compact and accessible winding station for simultaneously winding plural bobbins which includes a standby bobbin mount for use in bobbin-changing.

It is a further object of the present invention to provide a compact and accessible winding station for simultaneously winding plural yarns individually on plural bobbins which includes two winding units including a standby bobbin mount and means for alternating one of the yarns between the two winding units.

A further object of the present invention is the provision of a winding station including two staggered winding units including guide and distributing means for simultaneously winding a plurality of yarns an a corresponding plurality of bobbins, with the winding units including a standby bobbin mount and the guide means including means for selectively guiding one of the yarns for alternate supply between the two winding units.

A particular object of the present invention is the provision of a winding station having two staggered winding units having supply and guide means and distributing means for the simultaneous winding of four yarns on four bobbins, the winding unit adjacent the supply and guide means having two bobbin mounts and the other winding unit having three bobbin mounts, and means for directing one of the four yarns alternateley between the two winding stations after successive changes of the four wound bobbins.

BRIEF DESCRIPTION OF THE DRAWING

These and other objects of the invention and a better understanding thereof may be derived from the following description and the accompanying drawing, in which FIG. 1 is a schematic elevational view of the preferred form of winding station taken axially of the pilot rollers and bobbin mounts.

DETAILED DESCRIPTION OF THE PREFERRED EMBODIMENT

As shown in the drawing, the preferred form of the present invention comprises a winding installation including a plurality of winding stations 1, 1L and 1R which are closely adjacent and associated with each other. While three winding stations have been shown, it is to be understood that any number may be so associated.

The winding stations 1, 1L and 1R are the same and, for simplicity, only the central station 1 will be described in detail. The winding station 1 includes a frame 2 carrying an upper and a lower winding unit 3 and 4, respectively. The winding units 3 and 4 have cylindrical pilot rollers 5 and 6, respectively, whose axes are vertically staggered, on horizontally offset vertical planes, a distance which will be discussed more fully hereinafter.

The upper winding unit 3 includes a reciprocating yarn distributor 7 laterally adjacent and moveable parallel to the surface of the pilot roller 5, and the lower unit 4 has a corresponding distributor 8 associated with its pilot roller 6.

The upper winding unit 3 has a pair of bobbin mounts, here represented schematically by axle-circles 9 and 10. The bobbin mounts 9 and 10 may take any suitable form which allows for circumferential growth of the winding, such as that described in French Pat. No. 2,253,376, and are nested about the pilot roller 5 to operate within its two right-hand quadrants as shown in the drawings.

The lower pilot roller 6, however, has three such bobbin mounts 11, 12 and 13, respectively nested thereabout in its two right-hand quadrants and its lower-left quadrant.

Yarns are supplied to the winding station 1 via four guides 14, 15, 16 and 17 which are generally paired so that guides 14 and 15 align the filaments or yarns F1 and F2 with the lower distributor 8 while the guides 16 and 17 aligns the filaments F3 and F4 with the upper distributor 7.

However, a deflecting guide in the form of an elongate bar 18 is mounted parallel to the axis of the lower roller 6 and positioned to guide the yarn F3 on a deflected path around and beyond the upper distributor 7 and generally vertically downward toward the lower distributor, as will be discussed more fully hereinafter.

Advantageously, the deflecting bar 18 is mounted on the upper distributor 7 and therefor forms a compact unit for passing the yarn F3 beyond the distributor 7 without damage. Preferably, the bar 18 has a smooth, low-friction surface, such as a ceramic material, in its zone engaging the yarn.

The common assembly of the upper distributor 7 and the deflecting guide bar 18 thus governs the proper amount of lateral offset V5–V6 between the axes of the two pilot rollers 5 and 6, which preferably substantially equal to or slightly greater than the overall width dimension *E* of that assembly.

OPERATION OF THE PREFERRED EMBODIMENT

In operation, the yarns F1 through F4 are supplied from a source (not shown) via the guides 14 through 17 and are wound on bobbins on four of the five bobbin mounts 9–13, either driven by the pilot rollers or by other means.

As shown in the drawing, the yarn F3 is deflected to the lower winding unit by the deflecting guide 18 and has been wound on a bobbin of the lower unit 4. In the upper unit 3, only the bobbin mount 10 has been used, with the bobbin of mount 9 being in standby status.

When the bobbins of mounts 10–13 carry sufficient windings, the yarns are transferred and the bobbin mounts reloaded with empty bobbins in sequence and without substantial waste of yarn.

For example, starting with the full windings 110, 111, 112 and 113 shown in solid lines in the drawing, the sequence may be:

1. Yarn F4 is transferred from the winding 110 to the bobbin on mount 9 and winding of that yarn resumes immediately, while the winding 110 is removed and mount 10 reloaded;
2. Yarn F3 is released from the deflecting guide 18 and transferred from, for example, the winding 111 to the reloaded mount 10;
3. Yarn F2 is transferred from the winding 112 to the reloaded mount just vacated by yarn F3;
4. Yarn F1 is transferred from the winding 113 to the reloaded mount just vacated by yarn F2 (e.g. 12) and
5. mount 13 is reloaded with an empty, standby bobbin.

Winding of the bobbins on bobbin mounts 9, 10, 11 and 12 then continues, with yarn F3 engaged by the upper distributor 7, until windings 90, 110, 111 and 112 are complete. The winding station may then be reset in the sequence:

1. Yarn F1 is released from the winding 112 and transferred to the bobbin on mount 13;
2. Yarn F2 is released from the winding 111 and transferred to the reloaded bobbin mount 12;
3. Yarn F3 is released from the winding 100, deflected about the guide 18 and transferred to the reloaded bobbin mount 11;
4. Yarn F4 is released from the winding 90 and is transferred to the reloaded bobbin mount 10, and
5. bobbin mount 9 is reloaded with an empty, standby bobbin.

Winding of the bobbins on mounts 10 to 13 then continues, with the yarn F3 engaged by the lower distributor 8, until those bobbins are wound and reloading is again necessary.

The reloading of the bobbin mounts and transfer of the yarns may be done manually or, advantageously may be effected by an automatic changer of the type disclosed in U.S. patent application Ser. No. 566,811 filed Apr. 10, 1975.

With very quick changeover times, the variation of winding times will keep the variation of windings within normal limits. Accordingly, although in the first transfer example the bobbin on mount 9 started its wind first and that on the mount 12 started last; then that on mount 12 is the first replaced, while winding 90 continues, the variations in total winding will be acceptable.

The deflection of the yarn F3 about the deflecting guide 18 is not injurious to the yarn and does not adversely effect the winding. The guide bar is at least as long as the motion of the yarn enforced by the lower distributor 8 from its fixed point of guide 16. The deflection angle $\alpha$ caused by the guide bar 18 is only slight, in the order of 0° to 15° from the tangent thereof on pilot roller 6 on a typical station according to the invention.

The yarn thus transferred between the upper and lower winding units is thus easily distributed in common with the other yarn or yarns by whichever distributor 7 or 8 governs the unit to which it is then diverted.

Therefore, it is apparent that the present invention provides a particularly advantageous winding station which is capable of simultaneously winding four yarns on four bobbins and is further capable of bobbin exchange without substantial yarn wastage, all without increasing the floorspace requirements typical of prior art stations.

The new winding station therefore provides a uniquely compact, efficient, and waste-free winding station which avoids yarn wastage without an increase in factory floorspace and without limiting the accessibility of the winding units for maintenance and bobbin exchange.

It is to be understood that the present invention is applicable to the winding of yarns of all types including continuous filaments, spun fibers and like yarns whether natural, chemical or mineral or synthetic.

Various changes may be made in the details of the invention as disclosed without sacrificing the advantages thereof departing from the scope of the appended claims.

I claim:

1. A winding station for simultaneously winding a plurality of bobbins including a pair of vertically staggered winding units each winding unit including a pilot roller, bobbin mounting means and a reciprocating yarn distributor, the yarn distributor of each winding unit being positioned in an upper quadrant zone to guide yarn along a vertical plane tangential to the pilot roller, the bobbin mounting means of each winding unit including a pair of bobbin mounts adjacent their respective pilot roller and positioned in the upper and lower quadrant zones opposite from the side on which their respective yarn distributor is positioned, the bobbin mounting means of the lower of said winding units including a third bobbin mount in the quadrant zone underlying its respective yarn distributor, means for feeding a pair of yarns to each winding unit, and means for diverting one of the pair of yarns from the upper of said winding units to the lower winding unit.

2. The winding station of claim 1 in which the axes of the pilot rollers are substantially parallel and the lateral offset of the vertically staggered winding units is at least equal to the transverse width of the upper yarn distributor.

3. The winding station of claim 2 in which said deflecting means includes a deflecting guide positioned to guide the diverted yarn along a vertical plane tangential to the lower pilot roller and at a level adjacent the upper yarn distributor.

4. The winding station of claim 3 in which the deflecting guide is an elongated bar parallel to the axis of the pilot roller of the lower winding unit.

5. The winding station of claim 4 in which the deflecting bar is mounted on the yarn distributor of the upper winding unit.

6. The winding station of claim 4 in which the deflected yarn is deflected not more than 15° from its normal course to the upper winding unit.

* * * * *